US006345402B1

(12) United States Patent
Prows et al.

(10) Patent No.: US 6,345,402 B1
(45) Date of Patent: Feb. 12, 2002

(54) HINGED PANELS FOR A THERMAL SUPPORT APPARATUS

(75) Inventors: D. Scott Prows; Charles Goldberg, both of Cincinnati, OH (US); Rick A. Schmidt, Batesville; Rafael E. Aguilera, East Lawrenceburg, both of IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 09/533,531

(22) Filed: Mar. 23, 2000

Related U.S. Application Data

(62) Division of application No. 08/925,873, filed on Sep. 9, 1997, now Pat. No. 6,049,924.

(51) Int. Cl.[7] ..... A61G 11/00

(52) U.S. Cl. ..... 5/658; 5/600; 5/503.1; 600/22

(58) Field of Search ..... 5/600, 658, 503.1, 5/616; 40/498, 591, 612; 248/218.4, 230.1, 289.4; 600/22

(56) References Cited

U.S. PATENT DOCUMENTS

| | | | |
|---|---|---|---|
| 1,915,985 | A | 6/1933 | Edwards |
| 2,384,325 | A | 9/1945 | Marsan |
| 2,607,881 | A | 8/1952 | Anderson |
| 3,069,700 | A | 12/1962 | Berlin |
| 3,158,150 | A | 11/1964 | Croasdaile |
| 3,187,744 | A | 6/1965 | Dorsak et al. |
| 3,243,497 | A | 3/1966 | Kendall et al. |
| 3,335,713 | A | 8/1967 | Grosholz et al. |
| 3,358,957 | A | 12/1967 | Lindenmuth |

(List continued on next page.)

FOREIGN PATENT DOCUMENTS

| | | |
|---|---|---|
| CA | 789207 | 7/1968 |
| GB | 2 067 077 | 7/1981 |
| GB | 2 175 213 | 11/1985 |
| JP | 49-122184 | 11/1994 |
| WO | 90/09771 | 9/1990 |

OTHER PUBLICATIONS

"Stabilet" from Hill–Rom®, product brochure, 6 pages, 1992.
"Stabilet CC™ From Hill–Rom®" Product Brochure, six pages, 1992.
"The Stabilet™ Freestanding Warmer and Clinical Bassinet From Hill–Rom®" Product Brochure, four pages, 1993.
"A Hill–Rom Solution", Stabilet 2000C, Stabilet CC, Stabilet Freestanding Infant Warmer Accessories Product Brochure, eight pages, 1995.
"ISOLETTE® Infant Incubator . . . The Essence of Incubation", Air–Shields, Inc. Product Brochure, eight pages, 1996.
"The New Isolette® Infant Incubator Only From Air –Shields" Product Brochure, one page, date unknown.
Doores, Scott, "Voice Controlled Hospital Unit Provides VIP Treatment", Speakeasy (Scott Instrument Newsletter), Feb. 1991 Issue, p.2.
Prentke Romich Company, Hospital/Home Environmental Control System Product Brochure, date unknown.
Quartet Technology, Inc., Simplicity Series 5 Product Brochure, date unknown.

* cited by examiner

*Primary Examiner*—Michael F. Trettel
(74) *Attorney, Agent, or Firm*—Barnes & Thornburg

(57) ABSTRACT

A patient-support apparatus includes a base, a patient support carried above the base and a controller that controls at least one function of the patient support. A user interface panel includes a display and at least one button configured to provide an input signal to the controller. The user interface panel is coupled to the patient support for pivoting movement about more than one axis.

46 Claims, 10 Drawing Sheets

U.S. PATENT DOCUMENTS 3,662,981 A 5/1972 Hogrebe
3,889,914 A 6/1975 Torme
3,932,903 A 1/1976 Adams et al.
4,183,015 A 1/1980 Drew et al.
4,183,489 A 1/1980 Copher et al.
4,186,456 A 2/1980 Huempfer
4,321,913 A 3/1982 Maluta et al.
4,361,137 A 11/1982 Grosholz
4,409,695 A * 10/1983 Johnston et al. ..... 5/616
4,410,158 A 10/1983 Maffei
4,591,124 A 5/1986 Hellenbrand et al.
4,612,679 A 9/1986 Mitchell
4,641,385 A 2/1987 Peters et al.
4,680,790 A * 7/1987 Packard et al. ..... 5/658
4,750,474 A 6/1988 Dukhan et al.
4,773,392 A 9/1988 Koch
4,796,605 A 1/1989 Sasaki et al.
4,936,824 A 6/1990 Koch et al.
5,072,906 A 12/1991 Foster
5,100,091 A 3/1992 Pollak
5,112,293 A 5/1992 Vaccaro
5,129,117 A 7/1992 Celestina et al.
5,162,038 A * 11/1992 Wilker ..... 600/22
5,186,337 A 2/1993 Foster et al.
5,308,310 A 5/1994 Roff et al.
5,330,415 A * 7/1994 Storti et al. ..... 600/22
5,335,384 A 8/1994 Foster et al.
5,370,111 A 12/1994 Reeder et al.
5,453,077 A 9/1995 Donnelly et al.
5,498,229 A 3/1996 Barsky et al.
5,537,453 A 7/1996 Williams et al.
5,542,138 A * 8/1996 Williams et al. ..... 5/503.1 X
5,592,153 A 1/1997 Welling et al.
5,616,115 A 4/1997 Gloyd et al.
5,732,423 A 3/1998 Weismiller et al.
5,817,002 A * 10/1998 Donnelly et al. ..... 600/22
5,926,002 A * 6/1999 Cavanaugh et al. ..... 5/600 X
6,131,868 A * 10/2000 Welling et al. ..... 5/503.1 X

HINGED PANELS FOR A THERMAL SUPPORT APPARATUS

This is a division of U.S. Pat. Ser. No. 08/925,873, filed Sep. 9, 1997, now U.S. Pat. No. 6,049,924, assigned to the same assignee as this application.

BACKGROUND AND SUMMARY OF THE INVENTION

The present invention relates to a patient-support apparatus, and particularly, to a thermal support apparatus of the type having an isolation chamber with a thermally controlled environment. More particularly, the present invention relates to hinged panels, such as side guard panels, access door panels, and control panels, for the thermal support apparatus.

Thermal support devices, such as infant warmers and incubators, having an isolation chamber and various systems that maintain the isolation chamber at a controlled temperature and humidity to facilitate the development of a premature infant are known. Infant thermal support devices conventionally include a patient-support surface for supporting the infant in the isolation chamber and a set of side guard panels arranged around the patient-support surface. Many thermal support devices have a canopy over the patient-support surface. The canopy cooperates with the set of side guard panels to enclose the isolation chamber.

Conventionally, thermal support devices have access openings formed in one or more of the side panels and access door panels that normally close the access openings. When the access door panels are opened, a caregiver has access to the infant through the access openings. In such thermal support devices it is desirable that the access door panels have mechanisms that allow a caregiver with sterilized hands to open the access door panels without the use of his or her hands so that his or her hands remain sterilized.

The side guard panels of some thermal support devices are formed to include small windows with pass-through components in the windows. The pass-through components allow wires and tubes to pass through the side guard panels into the isolation chamber. It is desirable for the pass-through components to tightly seal against the side panels to which they are mounted to minimize leaks and to ensure that the pass-through components remain secure in the window formed in the side panel. It is also desirable that the wires and tubes pass through the pass-through components without too large of an opening being created in the pass-through component so that heat and air leaks are minimized.

The side guard panels of many thermal support devices can be moved from a raised position extending above the patient-support surface to a lowered position away from the patient-support surface to provide the caregiver with increased access to the patient. In many such thermal support devices, hinge mechanisms are provided for pivotably coupling the side panels to some other structure of the thermal support device and separate latching mechanisms are provided for locking the side guard panels in a raised position. It is desirable for the latching mechanisms to be easy to operate.

Infant thermal support devices having various systems that maintain the isolation chamber at a controlled temperature and humidity typically include a control panel that caregivers use to enter environmental control parameters, such as desired temperature and humidity levels. It is desirable for the control panels to be adjustable so that the caregiver can move the control panel to a desired position.

For example, it may be desirable to adjust the angle of the control panel to reduce glare on a read-out screen of the control panel.

According to the present invention, a patient-support apparatus is provided. The patient-support apparatus includes a base, a patient support carried by the base, and at least one side guard panel pivotably connected to the patient support for movement between first and second positions. The patient-support apparatus also includes a combined hinge and latch assembly for pivotably connecting the side guard panel to the patient support. The combined hinge and latch assembly includes a mount fixedly connected to the patient support, a hinge member fixedly connected to the side guard panel and rotatably connected to the mount for pivoting movement about an axis, and a stop mechanism coupled to the mount. The hinge member is movable along the axis between a locking position in which the stop mechanism engages the hinge member to prevent relative rotation between the hinge member and the mount and a releasing position in which the stop mechanism is disengaged from the hinge member to allow relative rotation between the hinge member and the mount.

The stop mechanism includes a lug formed in the mount. The hinge member is formed to include a lug-receiving space that receives the lug when the hinge member is in the locking position. When the hinge member is moved along the axis to the releasing position, the lug is positioned to lie outside the lug-receiving space so that the hinge member can pivot about the axis. Thus, the side guard panel can be unlocked for movement between the first and second positions by grabbing the side guard panel with one hand, moving the side guard panel so that the hinge member attached thereto is moved axially away from the mount, and then pivoting the side guard panel about the axis.

The patient support of the patient-support apparatus includes a platform tub formed to include an interior region and a platform cover that is positioned to lie above the interior region. The combined hinge and latch assembly includes a second member that is also coupled to the mount for pivoting movement about the axis. The second member includes a latch arm that extends over a portion of the platform cover to secure the platform cover on the platform tub. The mount is formed to include a second lug and the second member is formed to include a second lug-receiving space. The second member is movable along the axis between a locking position in which the second lug is received in the second lug-receiving space to lock the latch arm in the position extending over the portion of the platform cover and a releasing position in which the second lug is positioned to lie outside the second lug-receiving space to allow the second member to be pivoted to a position in which the latch arm is moved away from the platform cover.

Also according to the present invention, a patient-support apparatus includes a base and a patient support carried above the base and having a patient-support surface. The patient-support apparatus includes a side guard panel coupled to the patient support adjacent to the patient-support surface. The side guard panel is formed to include an access port and a flexible sealing member is coupled to the side guard panel adjacent to the access port. The patient-support apparatus further includes an access door assembly including a mounting block, a door panel, and a lever with a locking member.

The mounting block is coupled to the side guard panel. The door panel has a first end pivotably coupled to the mounting block and a second end spaced apart from the first end. The door panel is movable between a closed position in which the door panel engages the sealing member and closes the access port and an opened position in which the door panel is spaced apart from the sealing member so that the access port is opened. The lever has a first end pivotably coupled to the mounting block and a second end space apart from the first end. The lever is movable between a locking position in which the locking member engages the door panel to lock the door panel in the closed position and a releasing position in which the locking member is spaced apart from the door panel to unlock the door panel. The door panel has a portion that engages the lever to move the lever from the locking position to the releasing position when the second end of the door panel is moved toward the side guard panel.

The door panel extends from the first pivot axis beyond the mounting block in a first direction and the lever extends from the second pivot axis beyond the mounting block in a second direction that is opposite to the first direction. The door panel includes a hinge plate that couples to the mounting block and an access port cover coupled to the hinge plate. The lever includes a lever plate that couples to the mounting block and a handle coupled to the lever plate. The hinge plate of the door panel overlaps the lever plate of the lever when the door panel is in the closed position so that the access port cover of the door panel and the handle of the lever are positioned to lie on opposite sides of the mounting block. The hinge plate of the door panel is formed to include an aperture. The locking member extends through the aperture when the door panel is moved between the opened and closed positions.

According to one aspect of the present invention, a patient-support assembly includes a patient support and a side guard panel coupled to the patient support. The side guard panel has a first surface and a second surface spaced-apart from the first surface. The side guard panel also includes an edge defining a window in the side guard panel. The side guard panel being manufactured within a tolerance range so as to have a thickness that is between a maximum thickness and a minimum thickness. The patient-support apparatus includes a grommet received in the window of the side guard panel. The grommet includes a rim that engages the edge defining the window and a plurality of flexible flaps coupled to the rim and arranged to substantially fill the window.

The grommet also includes a first lip extending from the rim and arranged to engage the first surface of the side guard panel and a second lip extending from the rim and arranged to engage the second surface of the side guard panel. The second lip has a first portion adjacent to the rim and a second portion spaced apart from the rim and thicker than the first portion. The second lip is sufficiently flexible to sealingly engage the second surface of any side guard panel having a thickness within the tolerance range between the maximum and minimum thicknesses. The side guard panel is made out of acrylic having a thickness tolerance range of about +0.03 to about −0.06 inches.

According to another aspect of the present invention, a patient-support apparatus includes a base and a patient support carried above the base. The patient support includes a platform tub and a platform cover. The platform tub includes a first wall and a second wall spaced apart from the first wall to define an air flow channel therebetween. The platform cover is mounted to the platform tub to cover the air flow channel and the platform cover is formed to include a plurality of air vent slots. The patient-support apparatus includes an air flow guide having an elongated vent rail appended to the platform cover and extending into the air flow channel. The patient-support apparatus further includes an elongated vent panel pivotably coupled to the platform cover. The vent rail is formed to include a plurality of vent channels separated by abutment surfaces. The vent channels are in fluid communication with respective air vent slots. The vent panel is pivotable between a first position abutting the abutment surfaces and a second position moved away from the vent rail to provide increased access to the vent channels.

According to a further aspect of the present invention, a patient-support apparatus includes a base, a patient support carried above the base, an isolation chamber on the patient support, and a system for monitoring at least one environmental condition in the isolation chamber. The patient-support apparatus includes a user interface panel having buttons for entering system inputs and displays for observing system outputs. The user interface panel is rotatively mounted to the patient support through a rotatable member for pivoting movement about a vertical axis through about 180° so as to be accessible from opposite sides of the patient support. In addition, a hinge connects the user interface panel to the rotatable member to permit angling of the user interface panel with respect to the patient support. The hinge is a resistive hinge configured to resist pivoting of the user interface panel in response to normal actuating forces applied to the buttons of the user interface panel and configured to allow pivoting of the user interface panel in response to forces applied to the user interface panel that exceed the normal actuating forces.

Thus, the patient-support apparatus is provided with a number of hinged panels. The patient-support apparatus includes a side guard panel coupled to a patient support by a combined hinge and latch assembly. The patient-support apparatus also includes a door panel coupled for pivoting movement to a mounting block attached to the side guard panel and a lever coupled to the mounting block for movement to lock and unlock the door panel. The patient-support apparatus includes a grommet having a plurality of flaps that are flexibly coupled to a rim of the grommet. A vent panel is coupled to a platform cover of the patient support for pivoting movement relative to a vent rail that is formed to include vent channels. In addition, the patient-support apparatus includes a user interface panel coupled to the patient support by a resistive hinge.

Additional features and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which:

FIG. 14 is a sectional view of the access door assembly of FIG. 13, with portions broken away, showing the lever biased into a locking position by a large lever spring and a locking member coupled to the lever and arranged to engage a portion of the door panel to lock the door panel in a closed position and prevent the door panel from pivoting away from the side guard panel;

FIG. 15 is a view similar to FIG. 14 showing the lever depressed to a releasing position having the locking member disengaged from the door panel, the access door assembly including a latch coupled to the lever, and the latch hooking on a catch ledge formed in a mounting plate of the mounting block to lock the lever in the releasing position;

FIG. 16 is a view similar to FIG. 15 showing the door panel moved away from the side guard panel by a slight amount so that a reset lip formed in the door panel engages a reset rib formed in the latch to pivot the latch relative to the lever away from the catch ledge so that the lever spring acts to move the lever back to the locking position (in phantom);

FIG. 17 is a view similar to FIG. 16 showing the door panel pivoting toward the closed position and the reset lip of the door engaging the reset rib of the latch as the door panel pivots toward the closed position;

FIG. 18 is a view similar to FIG. 17 showing the door panel moved further toward the closed position to a position in which the reset lip of the door panel has snapped past the reset rib of the latch so that a camming surface formed in the door panel engages a camming surface formed in the locking member;

FIG. 19 is a view similar to FIG. 14 showing the door panel pivoted toward the side guard panel so that a portion of the door panel engages a portion of the lever to move the lever to the releasing position, the door panel pivoting automatically in the direction of the dotted arrow after the door panel is released;

DETAILED DESCRIPTION OF THE DRAWINGS

Figure 1:
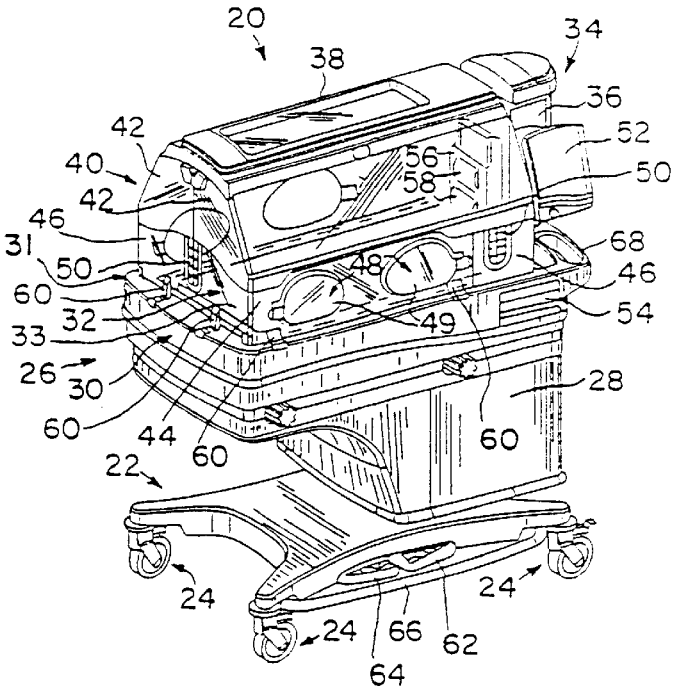
FIG. 1 is a perspective view of a patient-support apparatus according to the present invention showing a base, a patient support carried above the base, and an isolation chamber enclosed by an overlying canopy, a pair of transparent side guard panels, and a pair of transparent end guard panels.

A thermal support apparatus or patient-support apparatus 20, such as an infant warming device or incubator, includes a base 22, a plurality of castors 24 extending downwardly from base 22, and an infant supporting portion or patient support 26 supported above base 22 as shown in FIG. 1. Patient support 26 includes a pedestal 28 coupled to base 22 for vertical movement, a platform tub 30 supported by pedestal 28, a platform cover 31 coupled to platform tub 30, and a mattress 32 supported on platform tub 30. Mattress 32 has an upwardly facing patient-support surface 33. Patient-support apparatus 20 also includes a canopy support arm 34 including a telescoping vertical arm 36 and a horizontal overhead arm 38. A canopy 40 is coupled to overhead arm 38 and is positioned to lie above platform tub 30. Canopy 40 includes a pair of canopy halves 42 coupled to overhead arm 38 for pivoting movement between a lowered position shown in FIG. 1 and a raised position (not shown).

Figure 13:
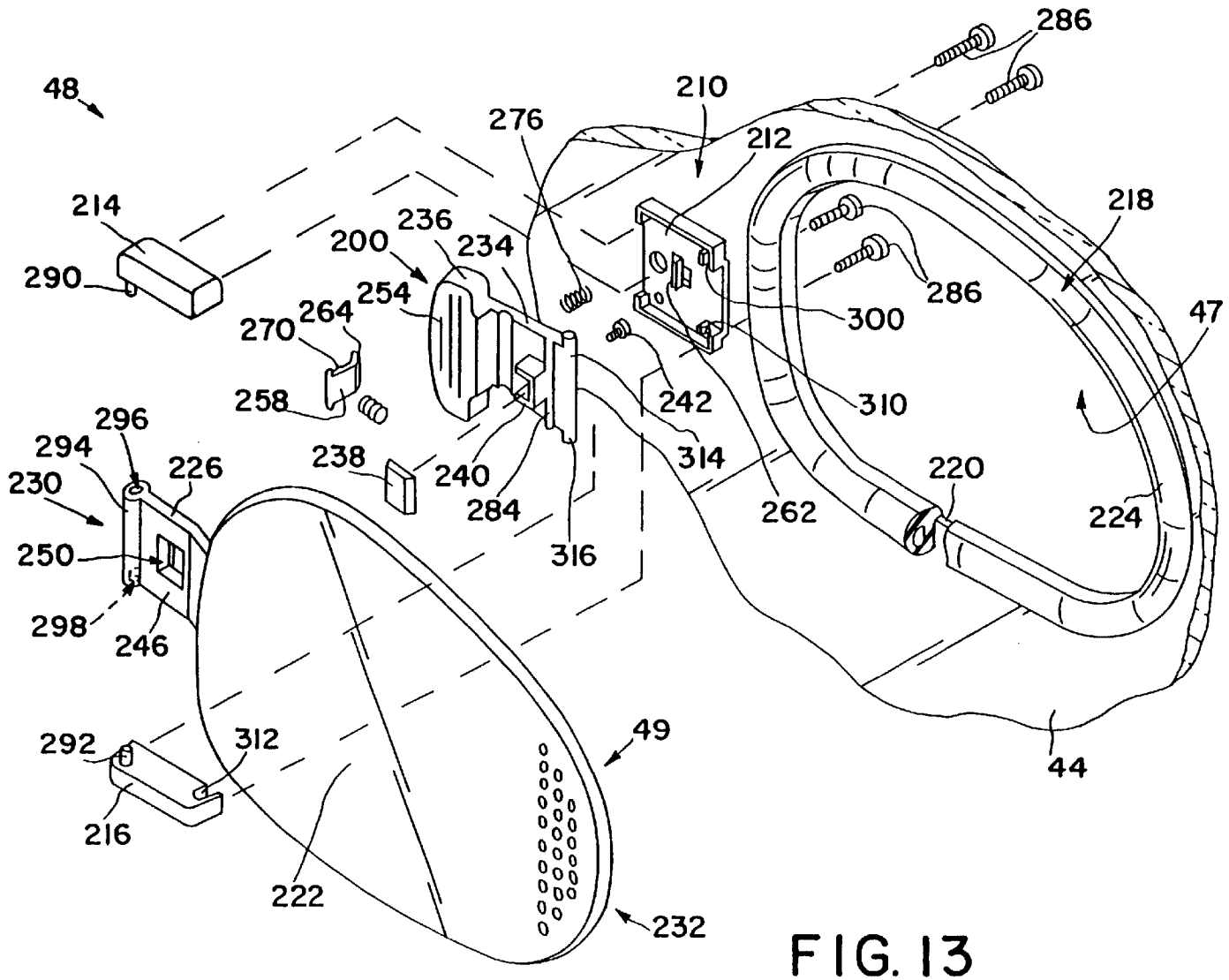
FIG. 13 is an exploded perspective view of an access door assembly of the patient-support apparatus of FIG. 1 showing the access door assembly including a door panel that moves to open and close an access port formed in the side guard panel, a lever that moves to lock and unlock the door panel, and a mounting block to which both the lever and door panel are coupled for pivoting movement.

A pair of transparent side guard panels 44 and a pair of transparent end guard panels 46 extend upwardly from platform tub 30 as shown in FIG. 1. Side guard panels 44 and end guard panels 46 cooperate with canopy halves 42 and overhead arm 38 to provide patient-support apparatus 20 with an isolation chamber. Side guard panels 44 are formed to include a pair of access ports 47, as shown in FIG. 13, that are normally closed by access door assemblies 48. Access door assemblies 48 include door panels 49 that can be opened to allow access to a patient, such as an infant, supported by thermal support apparatus 20 within the isolation chamber. Each end guard panel 46 is formed to include at least one U-shaped window and a pass-through grommet 50 is positioned to lie in each U-shaped window. Wires and tubes (not shown) can be routed into the isolation chamber through pass-through grommets 50.

Patient-support apparatus 20 includes a user interface panel 52 for monitoring various systems that control the temperature and humidity of the isolation chamber and for allowing caregivers to input various control parameters into memory of a control system of patient-support apparatus 20. Patient-support apparatus 20 also includes a humidifier module 54 that can be filled with water and inserted into a humidifier compartment of platform tub 30. Heated air is blown through humidifier module 54 and directed into the isolation chamber. A tower 56 is positioned to lie in the isolation chamber. Tower 56 supports various sensors 58, such as patient environmental sensors and light and noise sensors, and also provides a return-air path for the air being circulated through the isolation chamber.

Combined hinge and latch assemblies 60 are provided so that both side guard panels 44 and one of end guard panels 46 at the foot end of patient-support apparatus 20 can pivot downwardly away from canopy 40 to provide increased access to the infant supported by thermal support apparatus 20. Up and down buttons (not shown) can be pressed to extend and retract vertical arm 36 of canopy support arm 34, thereby raising and lowering, respectively, overhead arm 38 and canopy 40. Thermal support apparatus 20 includes an up pedal 62 that can be depressed to raise patient support 26 relative to base 22 and a down pedal 64 that can be depressed to lower patient support 26 relative to base 22. Thermal support apparatus 20 also includes a side bumper 66 that protects pedals 62, 64 and other components, such as base 22 and pedestal 28, from inadvertent impact. Platform tub 30 is formed to include a handle 68 on each side of canopy support arm 34. Handles 68 can be grasped by a caregiver to maneuver thermal support apparatus 20 during transport.

Other features of patient-support apparatus 20 are discussed in detail in co-pending applications Ser. Nos. 08/925,581; 08/926,380; 08/926,383; and 08/926,381, filed concurrently herewith, all of which are incorporated herein by reference.

Figure 2:
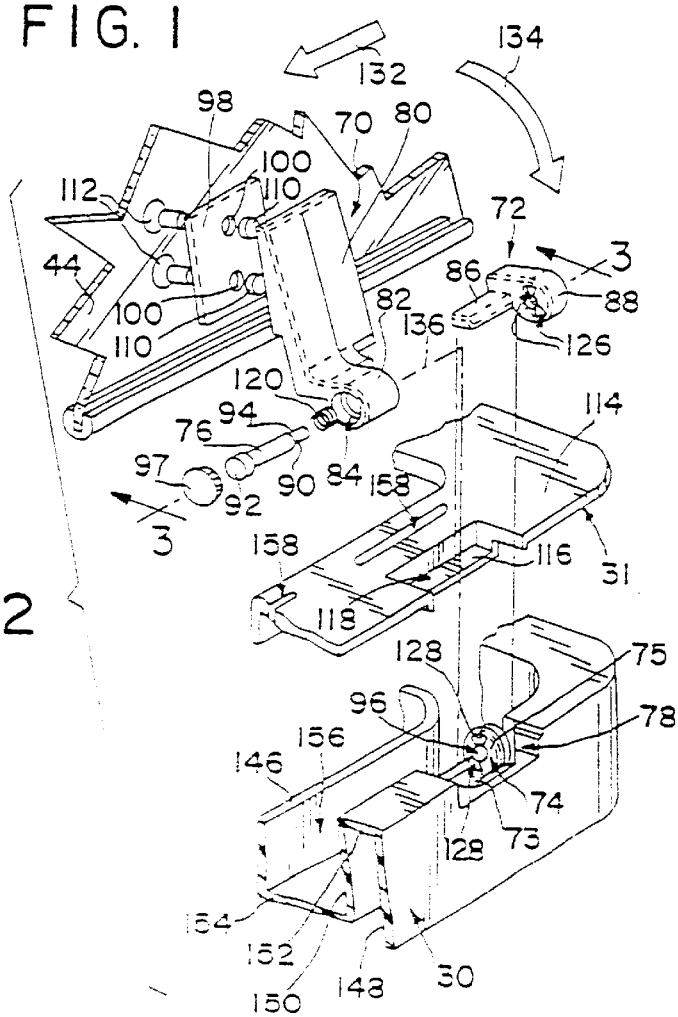
FIG. 2 is an exploded perspective view of a portion of the patient support and one of the side guard panels of FIG. 1 showing a platform tub of the patient support, a platform cover of the patient support overlying the platform tub, a combined hinge and latch assembly coupling the side guard panel to the platform tub, and the combined hinge and latch assembly including a mount coupled to the platform tub, a first member coupling the side guard panel to the mount, and a second member coupled to the mount and including an arm that overlies a portion of the platform cover to secure the platform cover to the platform tub.

Patient-support apparatus 20 includes a plurality of combined hinge and latch assemblies 60 that pivotably couple respective side and end guard panels 44, 46 to patient support 26 as previously described. Each combined hinge and latch assembly 60 includes a first member 70, a second member 72, and a mount 74 as shown in FIG. 2. Each combined hinge and latch assembly 60 also includes a pivot pin 76 that couples the first and second members 70, 72 to mount 74. Platform tub 30 is formed to include a plurality of hinge recesses 78 and each combined hinge and latch assembly 60 is coupled to platform tub 30 in the respective hinge recess 78. The description below of one of combined hinge and latch assemblies 60 in conjunction with the associated side guard panel 44 is descriptive of all hinge and latch assemblies 60 and the associated side and end guard panels 44, 46 unless specifically noted otherwise.

Figure 3:
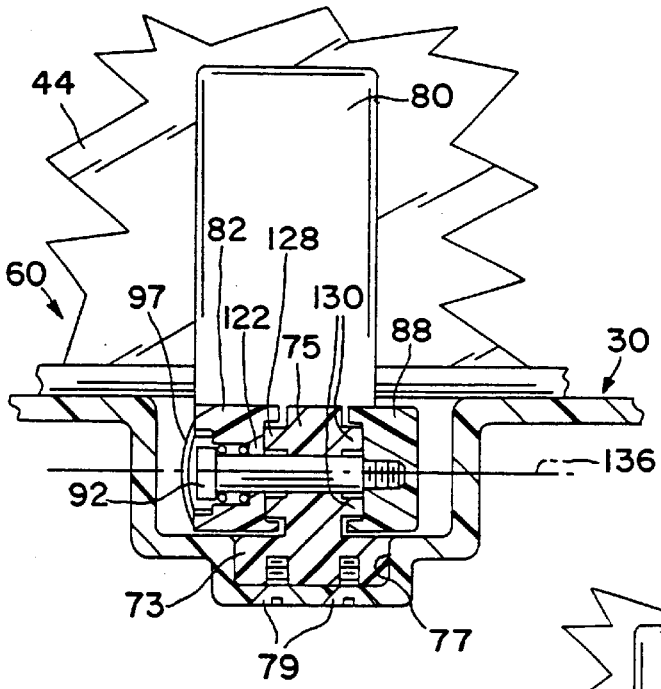
FIG. 3 is a sectional view taken along line 3—3 of FIG. 2 showing the mount having a first set of lugs received in respective lug-receiving spaces of the first member to lock the side guard panel in a raised position extending upwardly from the patient support and a second set of lugs received in respective lug-receiving spaces of the second member to lock the second member in a locking position having the platform cover secured to the platform tub.
Figure 4:
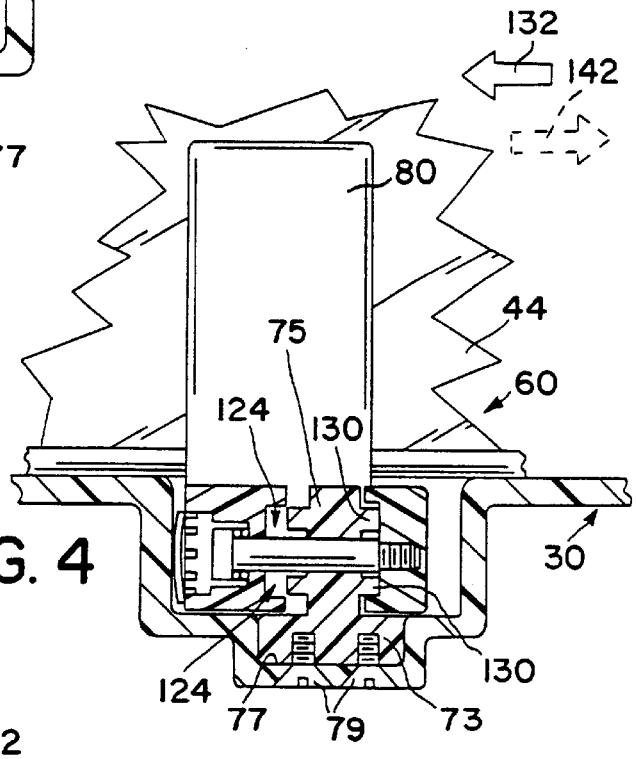
FIG. 4 is view similar to FIG. 3 showing the side guard panel and first member moved to the left so that the first set of lugs are positioned to lie outside the lug-receiving spaces of the first member.

Mount 74 of hinge and latch assembly 60 includes a mounting portion 73 received in a socket 77 formed in platform tub 30 and a hinge portion 75 extending upwardly from mounting portion 73 into hinge recess 78 as shown in FIGS. 2–4. A pair of screws 79 fasten mount 74 to platform tub 30 as shown in FIGS. 3 and 4. First member 70 includes a hinge arm 80 and a pivot body 82 extending from hinge arm 80 into hinge recess 78. Pivot body 82 is formed to include a bore 84 and pivot pin 76 extends through bore 84 to pivotably couple first member 70 to mount 74. Second member 72 includes a latch arm 86 and a pivot body 88. Platform cover 31 includes an upper surface 114 and a recessed ledge 116 that is offset downwardly from upper surface 114 to provide platform cover 31 with an arm recess 118 as shown in FIG. 2. Latch arm 86 of second member 72 is received in arm recess 118 and overlies recessed ledge 116 to secure platform cover 31 to platform tub 30. Pivot pin 76 includes a head 92 formed at one end thereof and a threaded portion 90 formed at another end thereof.

Hinge portion 75 of mount 74 is formed to include a bore 96 and pivot pin 76 extends from bore 84 formed in pivot body 82 through bore 96 formed in hinge portion 75 and threaded portion 90 threadedly couples to pivot body 88 so that a shoulder 94 of pivot pin 76 abuts pivot body 88. Combined hinge and latch assembly 60 includes a spring 120 mounted in compression between head 92 of pivot pin 76 and an internal shoulder 122, shown in FIG. 3, of pivot body 82. Combined hinge and latch assembly 60 also includes a cosmetic cap 97 mounted to pivot body 82 to cover bore 84 and shield pivot pin 76 from view. Thus, first member 70 and second member 72 are each coupled to mount 74 by pivot pin 76 for pivoting movement about a pivot axis 136 as shown in FIGS. 2 and 3.

Combined hinge and latch assembly 60 includes a backing plate 98 formed to include a pair of apertures 100 as shown in FIG. 2. Side guard panel 44 is formed to include a pair of apertures 110 that are aligned with apertures 100 of backing plate 98. A pair of bolts 112 extend through respective apertures 100, 110 and threadedly couple to hinge arm 80 of first member 70. Bolts 112 are tightened so that side guard panel 44 is clamped between backing plate 98 and hinge arm 80. Thus, first member 70 and side guard panel 44 are rigidly coupled together so that pivoting movement of side guard panel 44 about pivot axis 136 causes pivoting movement of first member 70 about pivot axis 136.

A set of first lug-receiving spaces 124 are formed in pivot body 82 of first member 70 as shown best in FIG. 4. A set of second lug-receiving spaces 126, similar to lug-receiving spaces 124, are formed in pivot body 88 of second member 72 as shown best in FIG. 2. Hinge portion 75 of mount 74 is formed to include a set of first lugs 128, shown best in FIG. 2, and a set of second lugs 130 as shown in FIGS. 3 and 4. Spring 120 acts between head 92 of pivot pin 76 and internal shoulder 122 of first member 70 to bias first and second members 70, 72 into engagement with mount 74.

When first lug-receiving spaces 124 are aligned with first set of lugs 128 and second lug-receiving spaces 126 are aligned with second set of lugs 130, spring 120 urges first member 70 into a locked position in which first set of lugs 128 are received in first lug-receiving spaces 124 and spring 120 urges second member 72 into a locked position in which second set of lugs 130 are received in second lug-receiving spaces 126 as shown in FIG. 3. Receipt of lugs 128 in lug-receiving spaces 124 prevents first member 70 and side guard panel 44 from pivoting relative to mount 74 and platform tub 30. In addition, receipt of lugs 130 in lug-receiving spaces 126 prevents second member 72 from pivoting relative to mount 74 and platform tub 30.

Although in a preferred embodiment, first and second set of lugs 128, 130 are formed in mount 74 and first and second lug-receiving spaces 124, 126 are formed in first and second members 70, 72, respectively, it is within the scope of the invention as presently perceived for the lugs and lug-receiving spaces to be formed in first member 70, second member 72, and mount 74 in a variety of ways. For example, mount 74 may be formed with lug-receiving spaces on either one side thereof or on both sides thereof and first and second members 70, 72 can be formed with lugs that mate with the lug-receiving spaces that are formed alternatively in mount 74. In addition, it is within the scope of the invention as presently perceived for the lugs and lug-receiving spaces to have shapes that are different than those shown in FIG. 2 and for a different number of lugs and lug-receiving spaces to be provided.

First lug-receiving spaces 124 and first set of lugs 128 are configured so that side guard panel 44 will remain locked in a raised position extending upwardly from patient support 26 when a force of fifty pounds is applied at the top of side guard panel 44. Side guard panel 44 can be moved from the raised position, shown in FIG. 1, to a lowered position shown in FIG. 6, by first moving side guard panel 44 in a longitudinal direction 132 and then pivoting side guard panel 44 in a direction 134 about pivot axis 136 of pivot pin 76 as shown in FIG. 2. When side guard panel 44 is moved in longitudinal direction 132, first member 70 is moved from the locked position, shown in FIG. 3, to an unlocked position in which first set of lugs 128 are no longer received in lug-receiving spaces 124 as shown in FIG. 4. Movement of first member 70 in direction 132 causes spring 120 to be further compressed between head 92 of pivot pin 76 and shoulder 122 of pivot body 82. When side guard panel 44 is pivoted in direction 134 about pivot axis 136 to the lowered position, combined hinge and latch assembly 60 is in the orientation shown in FIG. 5 having hinge arm 80 of first member and side guard panel 44 alongside platform tub 30.

Figure 5:
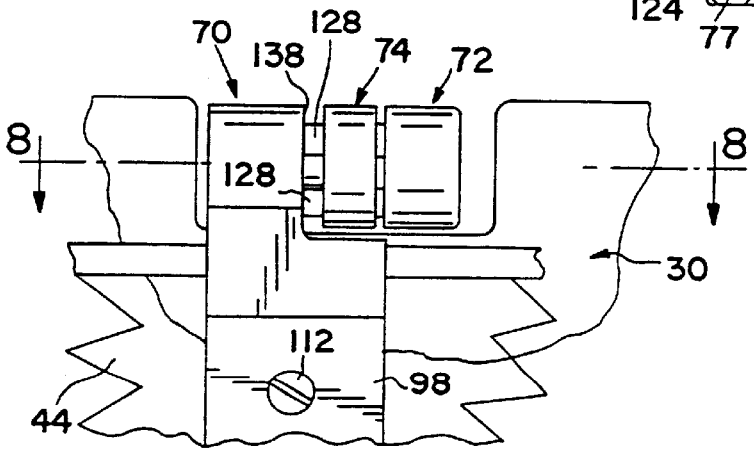
FIG. 5 is a side elevation view of the combined hinge and latch assembly of FIG. 4, with portions broken away, showing the side guard panel pivoted to a lowered position adjacent to an outer perimetral wall of the platform tub.
Figure 6:
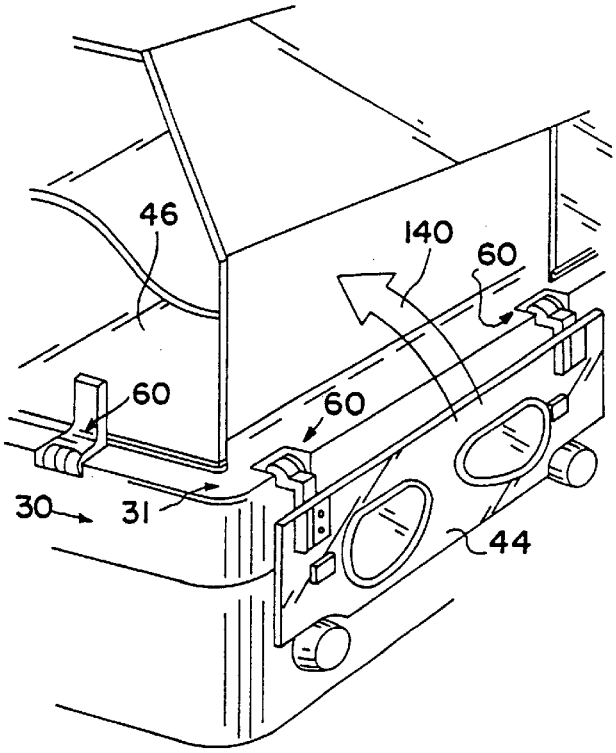
FIG. 6 is a perspective view of a portion of the patient-support apparatus of FIG. 1 showing the side guard panel in the lowered position and the side guard panel being movable in the direction of the double arrow back to the raised position.

When side guard panel 44 is in the lowered position, as shown in FIGS. 5 and 6, lug-receiving spaces 124 are misaligned with lugs 128 and spring 120 acts between head 92 and shoulder 122 to bias a face 138 of pivot body 82 against first set of lugs 128. During movement of side guard panel 44 in directions 132, 134, second set of lugs 130 remain inside lug-receiving spaces 126 so that second member 72 remains locked to mount 74. In a preferred embodiment, side guard panel 44 and first member 70 need to be moved only 0.09 inch (0.035 cm) in direction 132 before lugs 128 are no longer received in lug-receiving spaces 124.

Side guard panel 44 can be moved from the lowered position back to the raised position by pivoting side guard panel 44 in a direction 140 as shown in FIG. 6. When side guard panel 44 reaches the raised position, lug-receiving spaces 124 are once again aligned with lugs 128 and spring 120 acts between head 92 and shoulder 122 to move first member 70 and side guard panel 44 in a direction 142 as shown in FIG. 4 (in phantom) relative to mount 74 and platform tub 30. Thus, as soon as side guard panel 44 reaches the raised position, the respective combined hinge and latch assemblies 60 automatically operate to lock side guard panel 44 in the raised position. As is evident from the above description, combined hinge and latch assemblies 60 allow a caregiver to move side guard panels 44 between the raised and lowered positions with the use of just one hand.

Figure 8:
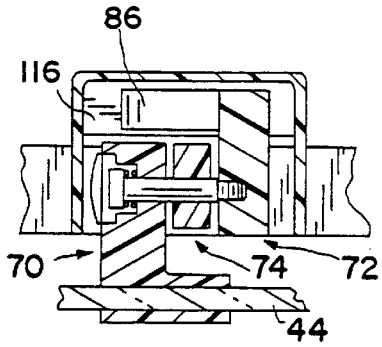
FIG. 8 is sectional view taken along line 8—8 of FIG. 5 showing the internal configuration of the combined hinge and latch assembly when the side guard panel is in the lowered position and the second member is locked to the mount.
Figure 9:
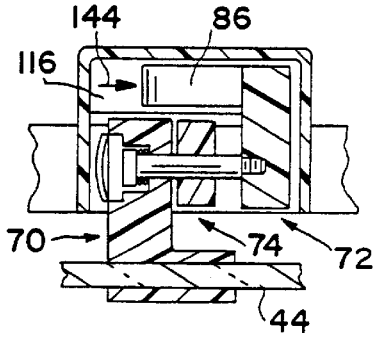
FIG. 9 is a view similar to FIG. 8 showing the second member moved to the right so that the second set of lugs are positioned to lie outside the lug-receiving spaces of the second member.

When side guard panels 44 are in the lowered position, second member 72 can be moved from the locked position, shown in FIG. 8, in a direction 144 to an unlocked position, shown in FIG. 9. After second member 72 is moved to the unlocked position, second set of lugs 130 are no longer received in second lug-receiving spaces 126. Second member 72 is then pivoted in direction 134 so that latch arm 86 is moved out of arm recess 118 to a releasing position. In a preferred embodiment, second member 72 needs to be moved only 0.09 inch (0.035 cm) in direction 142 to unlock second member 72 from mount 74.

Figure 10:
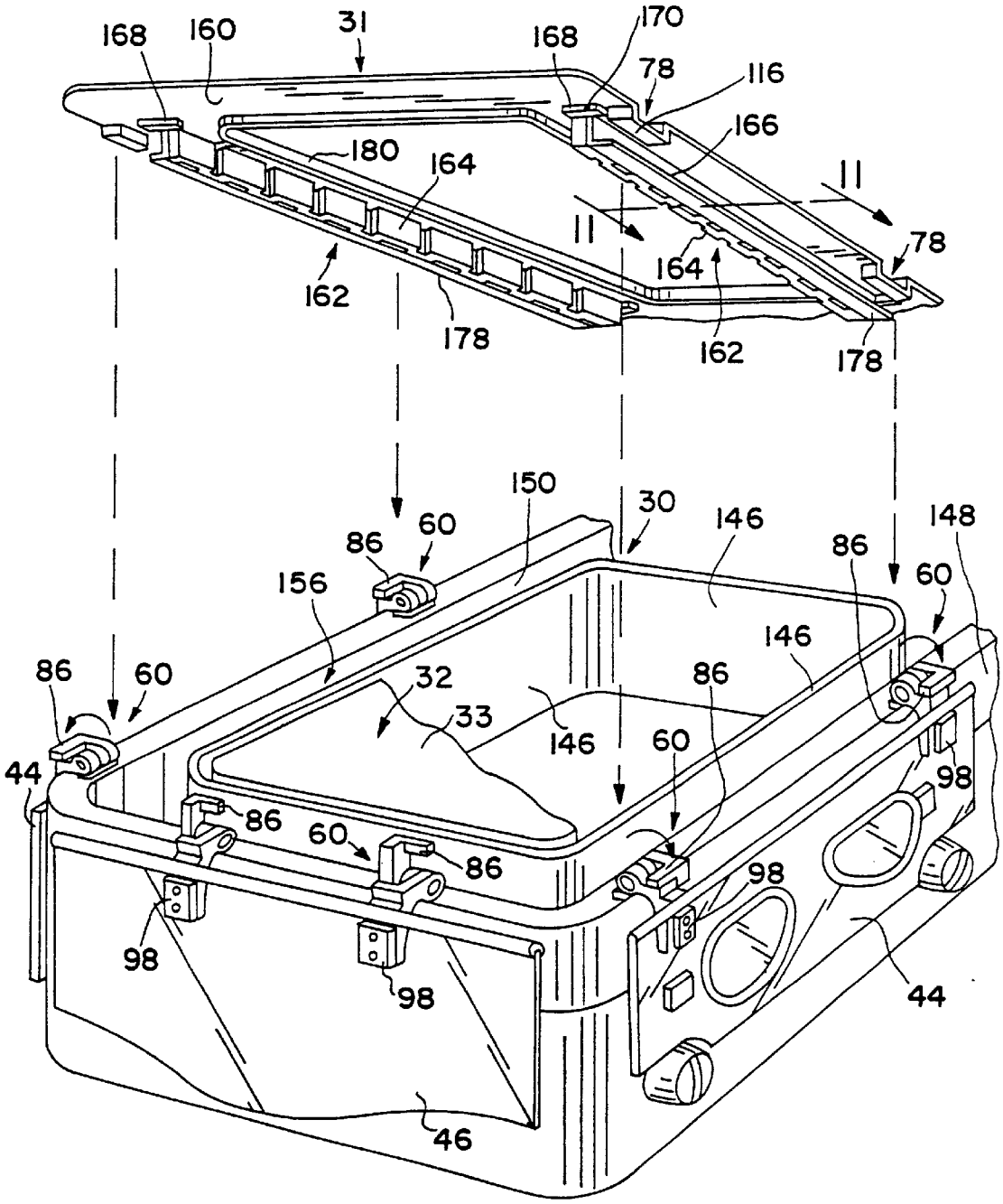
FIG. 10 is a perspective view of a portion of the patient-support apparatus showing all of the second members moved to respective unlocking positions allowing the platform cover of the patient support to be lifted away from the platform tub.

When all of the second members 72 of hinge and latch assemblies 60 associated with both side guard panels 44 and the end guard panel 46 at the foot end of patient support 26 are moved to respective releasing positions, platform cover can be separated away from platform tub 30 as shown in FIG. 10. Thus, each combined hinge and latch assembly 60 includes first member 70 that locks to mount 74 to secure side guard panel 44 in the raised position. In addition, each combined hinge and latch assembly 60 includes second member 72 that locks to mount 74 to secure platform cover 31 to platform tub 30. First member 70 can be moved in direction 132 from the locked position to the unlocked position and then side guard panel 44 can be moved in direction 134 from the raised position to a lowered position. In addition, second member 72 can be moved in direction 144 from the locked position to the unlocked position and then latch arm 86 can be moved in direction 134 so that platform cover 31 can be separated from platform tub 30.

Figure 11:
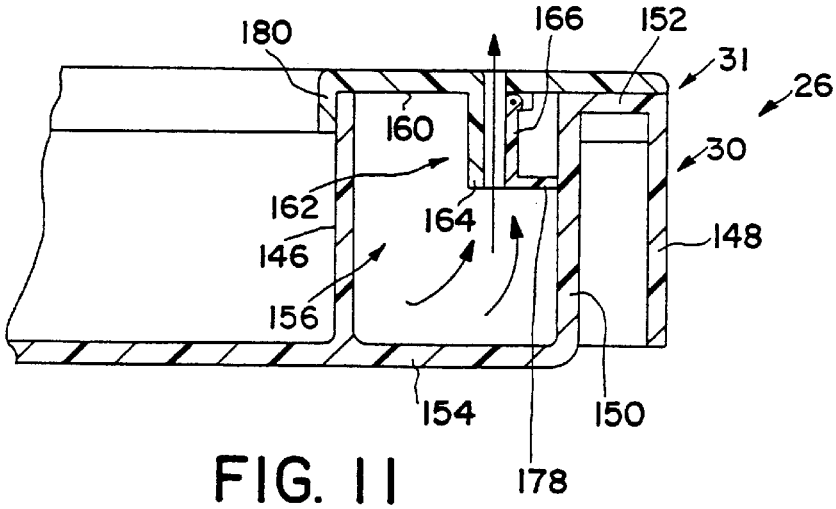
FIG. 11 is a sectional view taken along line 11—11 of FIG. 10 showing one of a pair of air flow guides appended to the platform cover and extending downwardly therefrom into a horizontal air flow channel formed in the platform tub.

Platform tub 30 includes a set of inner walls 146, a set of outer perimetral walls 148, and a set of intermediate walls 150 between outer perimetral walls 148 and inner walls 146 as shown in FIGS. 10 and 11. Platform tub 30 also includes a top wall 152 interconnecting outer perimetral walls 148 with intermediate walls 150 and a bottom wall 154 interconnecting inner walls 146 with intermediate walls 150. Inner walls 146 are spaced apart from intermediate walls 150 to provide platform tub 30 with a horizontal air channel 156 above bottom wall 154. Patient-support apparatus 20 includes an air circulation system (not shown) that forces air through horizontal air channel 156.

Figure 7:
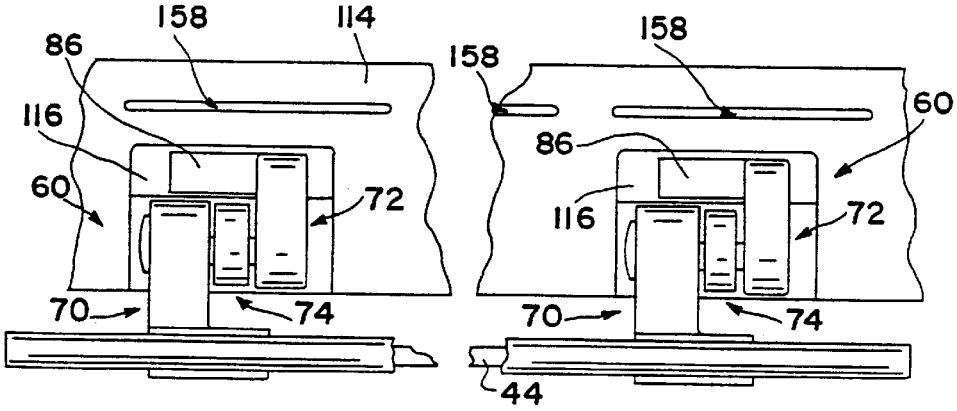
FIG. 7 is a top plan view of the side guard panel and combined hinge and latch assemblies of FIG. 6 showing both of the first members unlocked from the respective mounts and both of the second members locked to the respective mounts.
Figure 12:
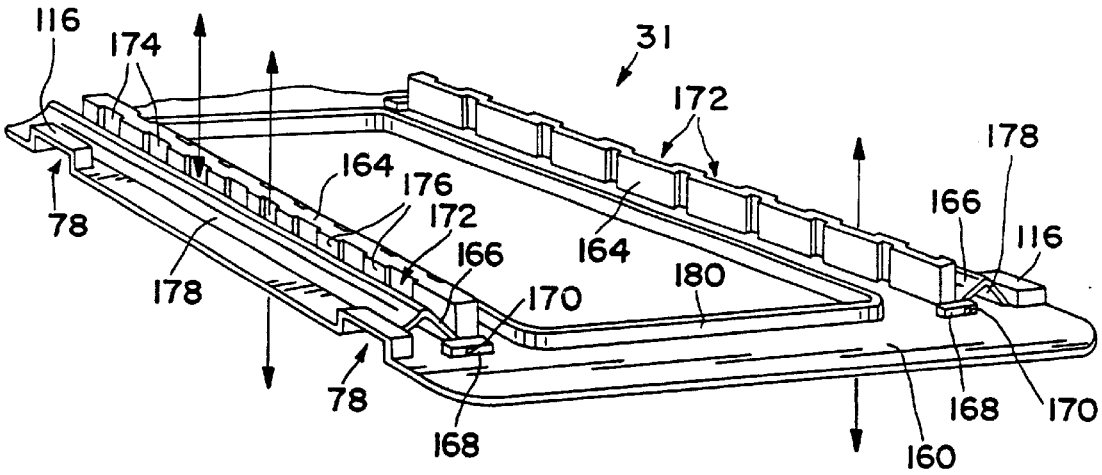
FIG. 12 is a perspective view of the platform cover of FIG. 10 showing each of the air flow guides including an elongated vent rail and an elongated vent panel, the vent rail formed with a plurality of vertical vent channels, and the vent panel pivoted away from the vent rail so that the vent channels are accessible for cleaning.

Platform cover 31 includes an undersurface 160 beneath upper surface 114 as shown in FIGS. 10–12. In addition, platform cover 31 is formed to include a plurality of vent slots 158, shown in FIGS. 2 and 7, that extend through platform cover 31 between upper surface 114 and undersurface 160. A pair of air flow guides 162 are coupled to platform cover 31 beneath vent slots 158 as shown in FIGS. 10–12. Each air flow guide 162 includes an elongated vent rail 164 appended to undersurface 160 and an elongated vent panel 166 pivotably coupled by pivot pins 170 to a set of pivot blocks 168 that are also appended to undersurface 160 as shown in FIG. 12.

Each elongated vent rail 164 is formed to include a plurality of vent channels 172 that are bounded by channel surfaces 174. Elongated vent rails 164 also include a plurality of abutment surfaces 176 between vent channels 172. Elongated vent panel 166 is movable from a first position in which vent panel 166 engages each of abutment surfaces 176 and a second position in which vent panel 166 is pivoted away from abutment surfaces 176. In the first position, vent panel 166 cooperates with vent rail 164 to provide a plurality of vertical air flow ducts that are coextensive with vent slots 158. Vent rail 164 and vent panel 166 cause the air flowing horizontally through horizontal air channel 156 to be redirected vertically through vent slots 158 and into the isolation chamber. When vent panel 166 is in the second position, channel surfaces 174 are accessible for cleaning.

A wall-engaging strip 178 is appended to vent panel 166 and extends therefrom in a perpendicular arrangement as shown in FIGS. 11 and 12. When platform cover 31 is secured to platform tub 30 by second members 72 of combined hinge and latch assemblies 60, wall-engaging strip 178 contacts intermediate wall 150 to secure vent panel 166 in the first position as shown in FIG. 11. In addition, platform cover 31 includes an inner perimetral lip 180 that engages inner walls 146 of platform tub 30 when platform cover 31 is secured to platform tub 30.

Patient-support apparatus 20 includes access door assemblies 48 having door panels 49 that are moved to open and close access ports 47 as previously described. Each access door assembly 48 further includes a lever 200 and a mounting block 210 to which both lever 200 and door panel 49 pivotably couple. Each mounting block 210 includes a mounting plate 212, a first hinge cap 214 coupled to mounting plate 212, and a second hinge cap 216 coupled to mounting plate 212 as shown in FIG. 13. The description below of one of access door assemblies 48 and the operation of access door assembly 48 is descriptive of all access door assemblies 48 unless specifically noted otherwise.

A flexible sealing member 218 is mounted to an edge 220 that defines the boundary of access port 47 as shown in FIG. 13. Door panel 49 includes an access port cover 222 that engages a sealing surface 224 of sealing member 218 when door panel 49 is in a closed position. Door panel 49 also includes a hinge plate 226 appended to access port cover 222. Hinge plate 226 of door panel 49 is pivotably coupled to mounting block 210 so that door panel 49 pivots about a first pivot axis 228 relative to mounting block 210 and side guard panel 44. Thus, door panel 49 has a first end 230 pivotably coupled to side guard panel 44 and a second end 232 spaced apart from first end 230. Second end 232 moves away from flexible sealing member 218 and side guard panel 44 when door panel 49 is moved from the closed position to the opened position.

Figure 14:
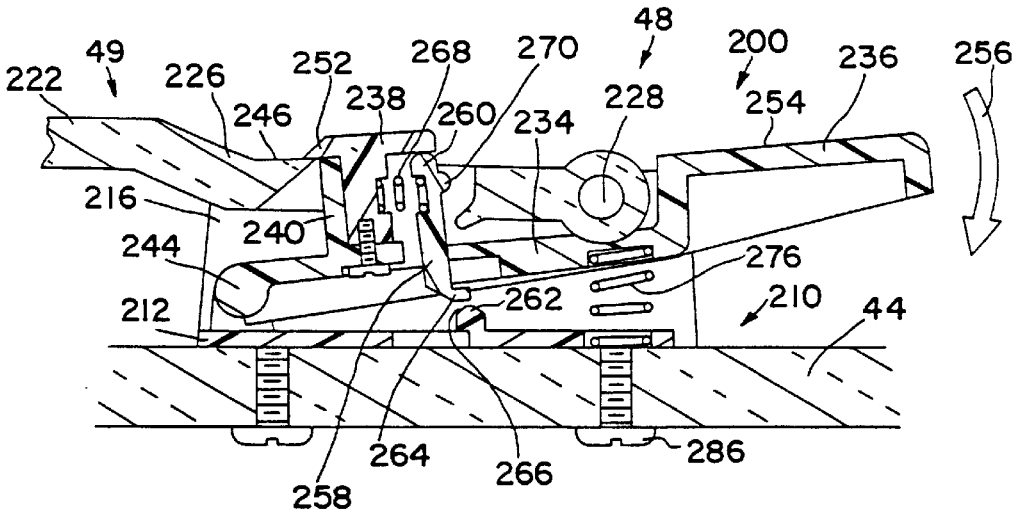
FIGS. 14–19 are a series of views showing movement of the lever and other associated access door assembly components to lock and unlock the door panel relative to the side guard panel.

Lever 200 includes a lever plate 234 and a handle 236 appended to lever plate 234 as shown in FIG. 13. Lever 200 is also provided with a locking member 238 that is fixed by suitable fastening means such as bolt 242 to a latch boss 240 formed in lever 200. Lever 200 is coupled to mounting block 210 for pivoting movement about a second pivot axis 244 that is substantially parallel with and spaced apart from first pivot axis 228. Hinge plate 226 of door panel 49 includes an outer surface 246, an inwardly facing surface 248, and a square-shaped aperture 250 extending between surfaces 246, 248. Locking member 238 includes a catch lip 252 that engages outer surface 246 of hinge plate 226 to lock door panel 49 in the closed position when lever 200 is in a locking position as shown in FIG. 14. Lever 200 is pivotable about second pivot axis 244 between the locking position and a releasing position, shown in FIG. 15, in which catch lip 252 is spaced apart from outer surface 246 of hinge plate 226 so that door panel 49 is unlocked for movement between the closed position and the opened position. Handle 236 includes a push surface 254 that can be engaged by a caregiver to pivot lever 200 about second pivot axis 244 in a releasing direction 256 as shown in FIG. 14.

Figure 15:
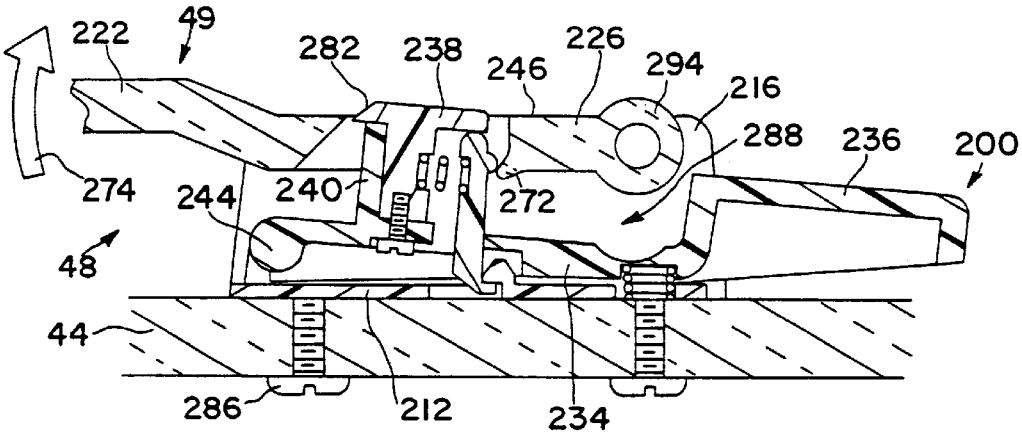

Access door assembly 48 includes a latch 258 that is pivotably coupled to latch boss 240 for pivoting movement about a pivot axis 260. Mounting plate 212 is formed to include a catch ledge 262 and latch 258 includes a catch lip 264 that hooks onto catch ledge 262 to lock lever 200 in the releasing position as shown in FIG. 15. Catch ledge 262 includes a camming surface 266 that pivots latch 258 toward latch boss 240 during movement of lever 200 from the locking position to the releasing position. Access door assembly further includes a latch spring 268 that compresses when latch 258 pivots toward latch boss 240 and that biases latch 258 away from latch boss 240 and into the positions shown in FIGS. 14, 15, and 17–19 when catch lip is either above or below catch ledge 262.

Figure 16:
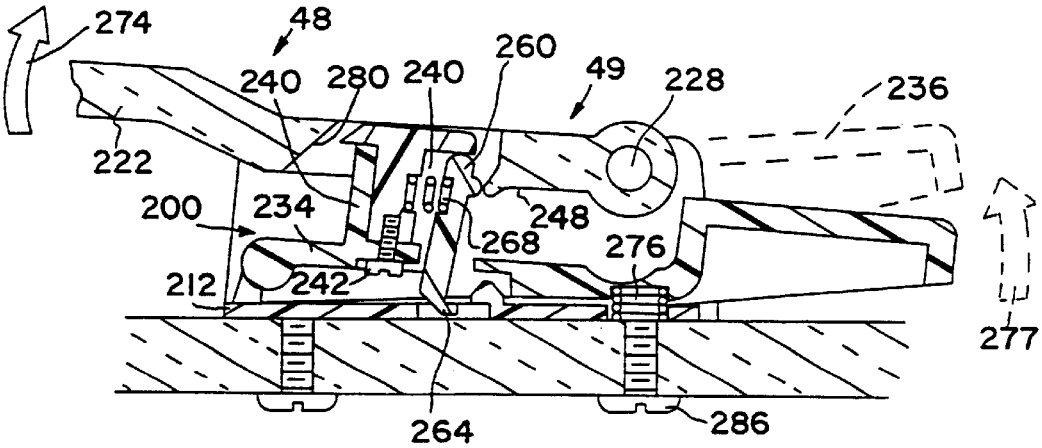

When lever 200 is locked in the releasing position by latch 258, door panel 49 can be grabbed and moved in an opening direction 274, shown in FIGS. 15 and 16, from the closed position to the opened position. Latch 258 is formed to include a reset rib 270 and hinge plate 226 of door panel 49 is formed to include a reset lip 272. As door panel 49 is moved in direction 274, reset lip 272 engages reset rib 270 to pivot latch 258 toward latch boss 240 so that catch lip 264 unhooks from catch ledge 262 as shown in FIG. 16. Door assembly 48 includes a lever spring 276 mounted between lever 200 and mounting plate 212 in a state of compression. When latch 258 unhooks from catch ledge 262, lever spring 276 acts to move lever 200 in a direction 277 from the releasing position back to the locking position as shown in FIG. 16 (in phantom). Access door assembly 48 is configured so that, when latch 258 unhooks from catch ledge 262, outer surface 246 of hinge plate 226 is pivoted away from locking member 238 by a sufficient amount that locking member 238 does not lock door panel 49 when lever 200 returns to the locking position in direction 277.

Figure 17:
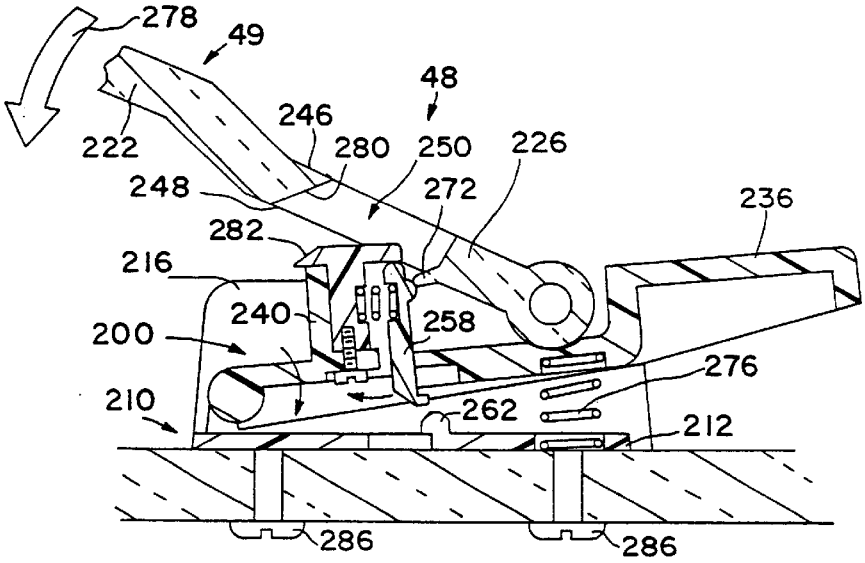

After door panel 49 has been moved to the opened position and the caregiver has gained access to the patient supported on mattress 32 for a desired length of time, the caregiver returns door panel 49 to the closed position by moving door panel 49 in a closing direction 278 as shown in FIG. 17. During movement of door panel 49 in closing direction 278, reset lip 272 engages reset rib 270 to pivot latch 258 toward pivot boss 240. However, lever 200 is held in the locking position by spring 276 so that reset lip 272 snaps past reset rib 270 and latch 258 returns to its initial position without catch lip 264 hooking on catch ledge 262.

Figure 18:
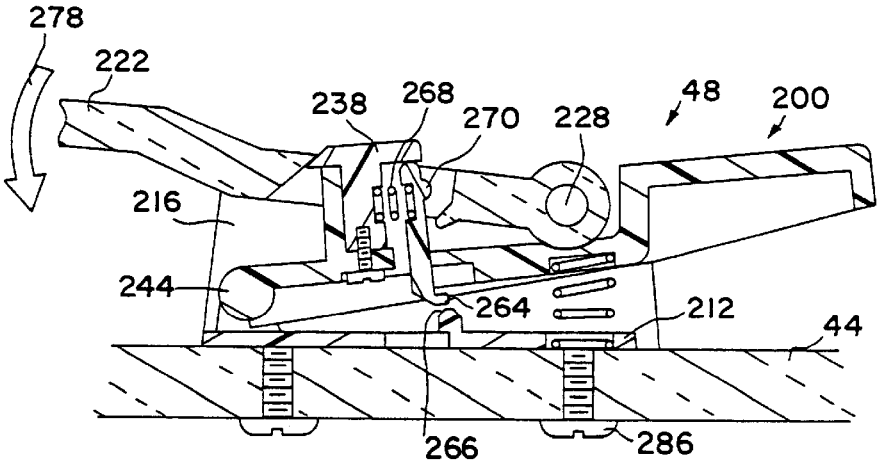

After reset lip 272 has moved past reset rib 270 and after further movement of door panel 49 in direction 278, a camming surface 280 of hinge plate 226 contacts a camming surface 282 of locking member 238 as shown in FIG. 18. As door panel 49 is moved further in direction 278, camming engagement between surface 280 and surface 282 causes lever 200 to deflect away from the locking position by a slight amount until outer surface 246 of hinge plate 226 is beneath catch lip 252 at which point spring 276 returns lever 200 back to the locking position so that catch lip 252 engages outer surface 249 to lock door panel 49 in the closed position as shown in FIG. 14. When, door panel 49 is returned to the closed position, sealing surface 224 of sealing member 218 engages door panel 49 to resist movement of door panel 49 in direction 278 past the closed position.

Thus, door panel 49 can be unlocked for movement from the closed position to the opened position by moving lever 200 in direction 256 from the locking position, shown in FIG. 14, to the releasing position, shown in FIG. 15. Door panel 49 can then be grabbed and moved in direction 274 through the positions shown in FIGS. 16 and 17 to the opened position. Door panel 49 can be returned to the closed position by pivoting door panel 49 from the opened position through the positions shown in FIGS. 17 and 18 back to the closed position shown in FIG. 14. As door panel 49 is moved between the opened and closed positions, locking member 238 moves through aperture 250 formed in hinge plate 226 of door panel 49. When door panel 49 is returned to the closed position, locking member 238 automatically locks door panel 49 in the closed position.

Figure 19:
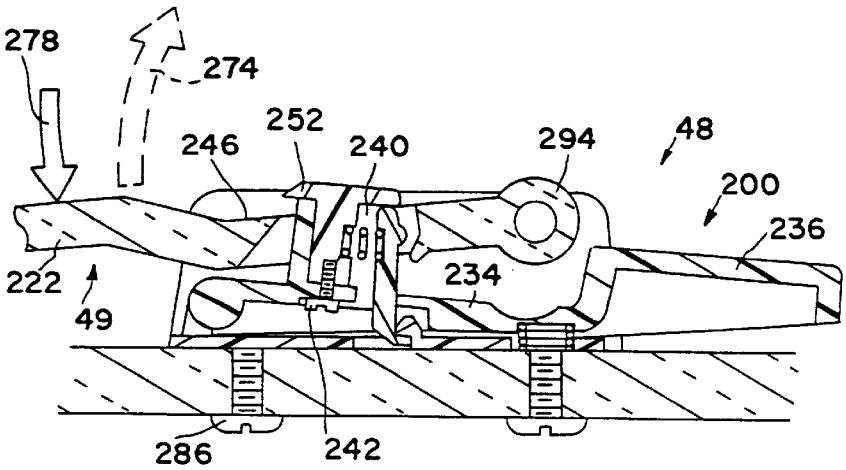

Door panel 49 can also be moved from the closed position to the opened position by first moving second end 232 of door panel 49 toward side guard panel 44 in direction 278 and then releasing second end 232. As second end 232 of door panel 49 is moved toward side guard panel 44, the portion of flexible sealing member 218 that abuts second end 232 of door panel 49 is resiliently compressed between second end 232 and side guard panel 44. When second end 232 is released, the compressed portion of flexible sealing member 218 acts between side guard panel 44 and second end 232 to swing door panel 49 in opening direction 274 as shown in FIG. 19 (in phantom). As second end 232 of door panel 49 is moved toward side guard panel 44, inwardly facing surface 248 of hinge plate 226 engages an actuating rib 284, shown in FIG. 13, that is appended to lever plate 234 of lever 200. Engagement between inwardly facing surface 248 and actuating rib 284 causes lever 200 to be moved from the locking position to the releasing position as shown in FIG. 19. When lever 200 reaches the releasing position, latch 258 acts to lock lever 200 in the releasing position as described above with reference to FIG. 15.

Thus, there are two ways in which door panel 49 can be unlocked and moved to the opened position from the closed position. One way is by pushing on push surface 254 to move lever 200 to the releasing position and then grabbing door panel 49 and moving it to the opened position. The second way is by pushing second end 232 toward side guard panel 44 and then releasing second end 232 so that flexible sealing member 218 acts to swing door panel 49 to the opened position. The second way of opening door panel 49 allows a caregiver with sterilized hands to open door panel 49 with his or her elbow so that his or her hands remain sterilized.

Mounting block 210 includes mounting plate 212, first hinge cap 214, and second hinge cap 216 as previously described. Mounting plate 212 is fastened to side guard panel 44 by suitable fastening means such as mounting bolts 286. First and second hinge caps 214, 216 extend away from side guard panel 44 and mounting block 210 to define a lever-receiving recess 288 therebetween as shown, for example, in FIG. 15. Mounting block 210 is configured so that lever plate 234 is received in lever-receiving space 288 and handle 236 is positioned to lie outside lever-receiving space 288. In addition, hinge plate 226 is received in lever-receiving space 288 and access port cover 222 is positioned to lie outside lever-receiving space 288 when door panel 49 is in the closed position.

First hinge cap 214 includes a first post 290 and second hinge cap 216 includes a second post 292 as shown in FIG. 13. A pivot cylinder 294 is formed in hinge plate 226 at first end 230 of door panel 49 as also shown in FIG. 13. Pivot cylinder 294 is formed to include a first socket 296 and a second socket 298. First post 290 is received in first socket 296 and second post 292 is received in second socket 298 so that door panel 49 is coupled to mounting block 210 for pivoting movement about first pivot axis 228.

Mounting plate 212 is formed to include a first curved bearing surface 300 and a second curved bearing surface 310 as shown in FIG. 13. In addition, second hinge cap 216 includes a curved bearing surface 212 and first hinge cap 214 includes a curved bearing surface (not shown) that is substantially similar to curved bearing surface 312 of second hinge cap 216. Lever 200 includes a first pivot post 314 and a second pivot post 316, both of which are appended to lever plate 234. First pivot post 314 is trapped for pivoting movement between first curved bearing surface 300 of mounting plate 212 and the curved bearing surface of first hinge cap 214. Second pivot post 316 is trapped for pivoting movement between second curved bearing surface 310 of mounting plate 312 and curved bearing surface 312 of second hinge cap 216.

As can be seen in FIGS. 14–19, a portion of lever plate 234 of lever 200 is positioned to lie between pivot cylinder 294 and mounting plate 212. In addition, door panel 49 extends from first pivot axis 228 in a first direction beyond mounting block 210 and lever 200 extends from second pivot axis 244 in a second direction opposite to the first direction past mounting block 210. In addition, hinge plate 226 of door panel 49 overlaps lever plate 234 of lever 200 when door panel 49 is in the closed position so that lever plate 234 is positioned to lie between hinge plate 226 and mounting plate 212.

Patient-support apparatus 20 includes a number of pass-through grommets 50 through which wires and tubes can be routed into the isolation chamber as previously described. The description below of one pass-through grommet 50 is descriptive of all pass-through grommets 50 unless specifically noted otherwise.

Figure 20:
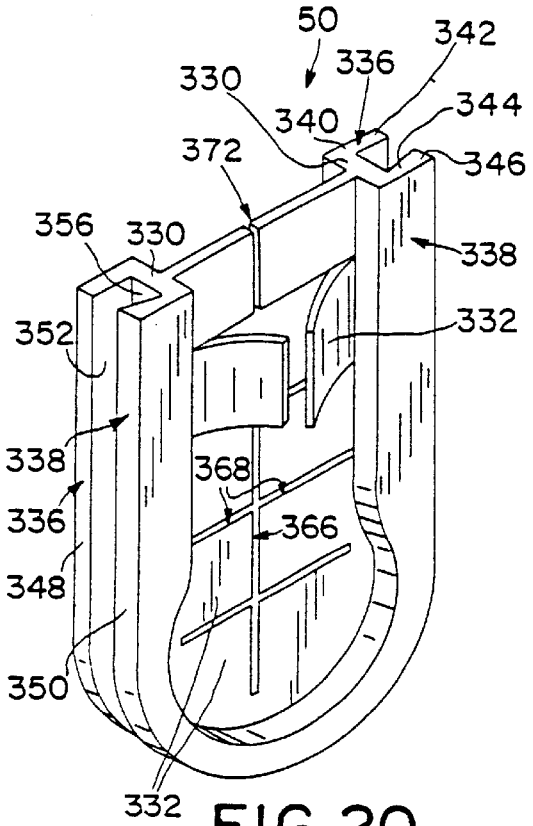
FIG. 20 is a perspective view of a pass-through grommet of the patient-support apparatus of FIG. 1 showing the pass-through grommet including a plurality of flexible flaps, a rim to which each of the flaps are appended, a first lip of uniform thickness appended to the rim, and a second lip of non-uniform thickness appended to the rim.
Figure 21:
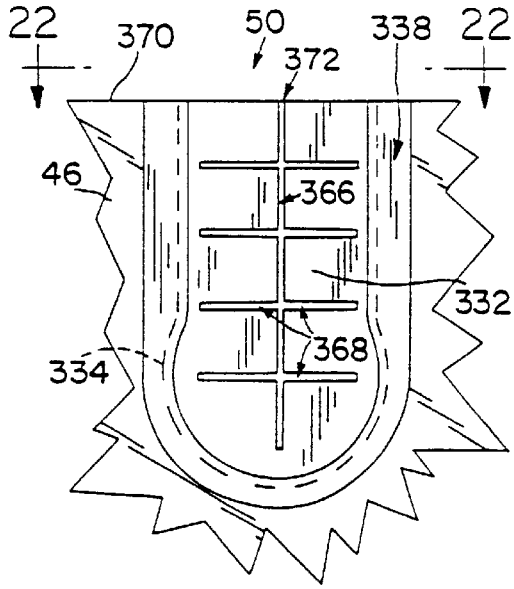
FIG. 21 is a side elevation view of the grommet of FIG. 20 showing the grommet received in a window formed in one of the side guard panels, the rim extending around the grommet along a somewhat keyhole-shaped path, and an outer edge of the second lip being U-shaped.

Pass-through grommet 50 includes a rim 330 and a plurality of flexible flaps 332 appended to rim 330 as shown in FIG. 20. Rim 330 is somewhat keyhole shaped and flaps 332 are arranged to substantially fill the space between the spaced-apart vertical portions of rim 330 and above the lower curved portion of rim 330. End guard panels 46 each include at least one keyhole-shaped edge 334, as shown in FIG. 21 (in phantom), that defines a window in the respective end guard panel 46. Pass-through grommets 50 are received in respective windows so that an edge-engaging surface 356 of rim 330 engages edge 334. The keyhole shape of rim 330 and edge 334 secures pass-through grommet 50 in the respective window to prevent pass-through grommet 50 from falling out of the window, for example, when end guard panel 46 with combined hinge and latch assemblies 60 is pivoted to the lowered position.

Pass-through grommet 50 includes a first lip 336 and a second lip 338, each of which are appended to rim 330 as shown in FIG. 20. First lip 336 includes an inner portion 340 appended to rim 330 and an outer portion 342 that is spaced apart from rim 330 and that is substantially the same thickness as inner portion 340. Second lip 338 includes an inner portion 344 appended to rim 330 and an outer portion 336 that is spaced apart from rim 330 and that is thicker than inner portion 344. Thus, first lip 336 has a substantially uniform thickness around the periphery of rim 330 and second lip 338 has a non-uniform thickness around the periphery of rim 330.

Figure 22:
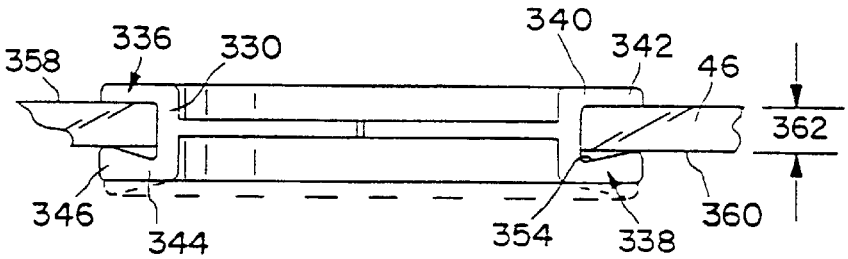
FIG. 22 is a top plan view of the grommet and side guard panel of FIG. 21 showing the side guard panel having a thickness at a minimum of the tolerance range and the first and second lips tightly sealing against the minimum-thickness side guard panel.

First lip 336 includes a U-shaped outer edge 348 and second lip 338 includes a U-shaped outer edge 350. First lip 336 includes a sealing surface 352 extending between outer edge 348 and rim 330 and second lip 338 includes a sealing surface 354 extending between outer edge 350 and rim 330 as shown in FIG. 22. Sealing surface 352 of first lip 336 is substantially perpendicular to edge-engaging surface 356 of rim 330 and sealing surface 354 of second lip 338 is angled with respect to edge-engaging surface 356 of rim 330. In addition, sealing surface 352 confronts sealing surface 354 so that a panel-receiving space 358 is defined between first and second lips 336, 338 as shown in FIG. 20.

Figure 23:
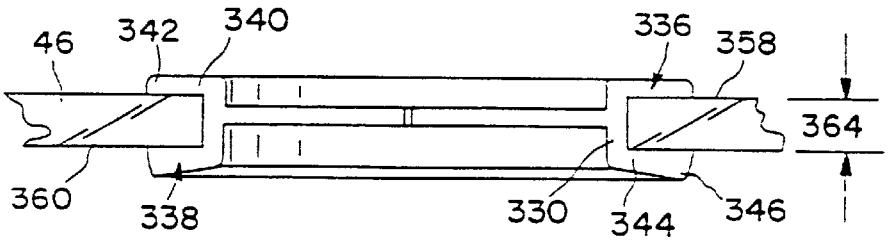
FIG. 23 is a view similar to FIG. 22 showing the side guard panel having a thickness at a maximum of the tolerance range and the first and second lips tightly sealing against the maximum-thickness side guard panel.

Each end guard panel 46 includes a first surface 358 and a second surface 360 that is substantially parallel with and spaced apart from first surface 360. The distance between surfaces 358, 360 determines the thickness of end guard panel 46. Any one end guard panel 46 selected from a number of end guard panels 46 will have a thickness within a tolerance range due to the manner in which end guard panels 46 are manufactured. For example, it is possible for end guard panel 46 to have a minimum thickness 362, as shown in FIG. 22, and it is also possible for end guard panel 46 to have a maximum thickness 364, as shown in FIG. 23. Of course, end guard panel 46 could have a thickness between minimum and maximum thicknesses 362, 364. In a preferred embodiment, end guard panels 46 are made out of commercially available acrylic and have a thickness tolerance range of +0.03 to −0.06.

Pass-through grommet 50 is able to seal tightly against outwardly-facing and inwardly-facing surfaces 358, 360 of end guard panels 46 having minimum thickness 362, maximum thickness 364, or any thickness therebetween. When grommet 50 is mounted to end guard panel 46 having minimum thickness 362, sealing surface 352 of first lip 336 abuts first surface 358 of end guard panel 46 and inner portion 344 of second lip 338 flexes by a minimum amount so that a portion of sealing surface 354 adjacent to outer portion 346 of second lip 338 abuts second surface 360 as shown in FIG. 22. When grommet 50 is mounted to end guard panel 46 having maximum thickness 364, sealing surface 352 of first lip 336 abuts first surface 358 of end guard panel 46 and inner portion 344 of second lip 338 flexes by a maximum amount so that substantially the entire sealing surface 354 of second lip 338 abuts second surface 360 as shown in FIG. 23. Pass-through grommet 50 can be made from any soft, low durameter rubber or plastic.

In use, wires and tubes (not shown), such as EKG wires and intravenous feeding tubes, are routed from external devices through pass-through grommet 50 into the isolation chamber in which the patient, such as an infant, resides. Pass-through grommet 50 includes a vertical slit 366 and a plurality of horizontal slits 368 that cooperate to provide grommet 50 with the plurality of flaps 332. The flaps 332 in contact with the wires and tubes that are routed through grommet 50 flex and the other flaps 332 remain in an unflexed configuration. Thus, flaps 332 operate to minimize the size of the opening that is created in grommet 50 when wires and tubes are routed therethrough, thereby minimizing the amount of heat and air losses through the opening created in grommet 50.

End guard panel 46 includes a top edge 370 and the top of grommet 50 is substantially coextensive with top edge 370 as shown in FIG. 21. In addition, vertical slit 366 provides grommet 50 with a top opening 372. Wires and tubes can be passed downwardly through top opening 372 and into vertical slit 366. In addition, wires and tubes that are routed through grommet 50 can be moved upwardly through vertical slit 366 and then through top opening 372 to remove the wires and tubes from grommet 50. By providing grommet 50 with top opening 372, the wires and tubes that are attached to the patient in the isolation chamber can remain attached to the patient when end guard panel 46 at the foot end of patient support 26 is pivoted to the lowered position, or when end guard panel 46 at the head end of patient support 46 is removed.

In a preferred embodiment, grommets 50 are received in windows formed in end guard panels 46. However, it is within the scope of the invention as presently perceived for grommets 50 to be received in similar windows formed in side guard panels 44.

Figure 24:
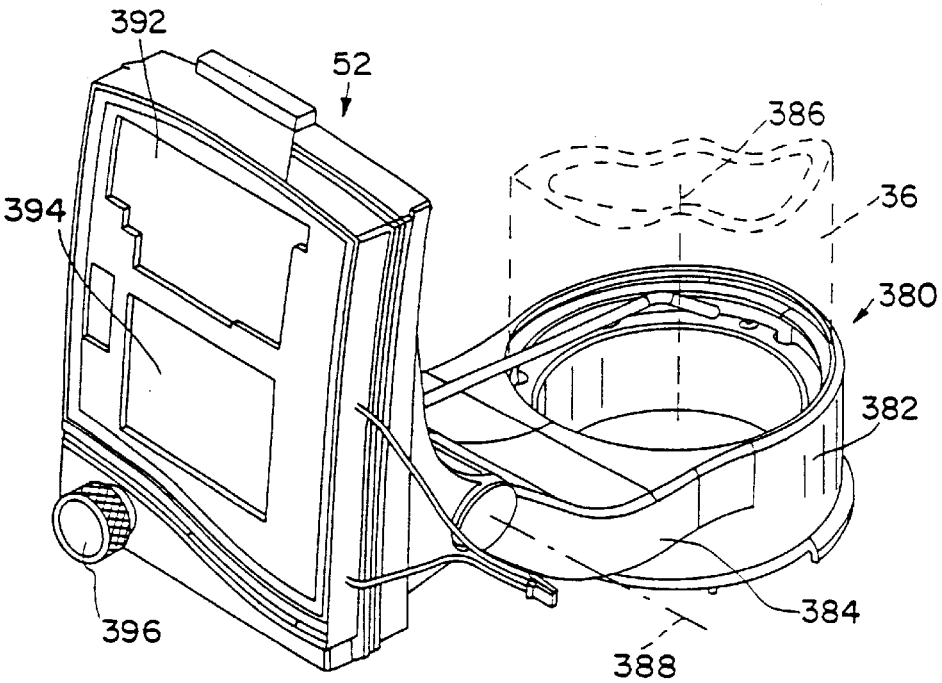
FIG. 24 is a perspective view of a user interface panel and pivot collar of the patient-support apparatus of FIG. 1 showing the user interface panel coupled to the pivot collar for pivoting movement about a horizontal pivot axis and the pivot collar coupled to a vertical arm (in phantom) of a canopy support arm for pivoting movement about a vertical pivot axis.
Figure 25:
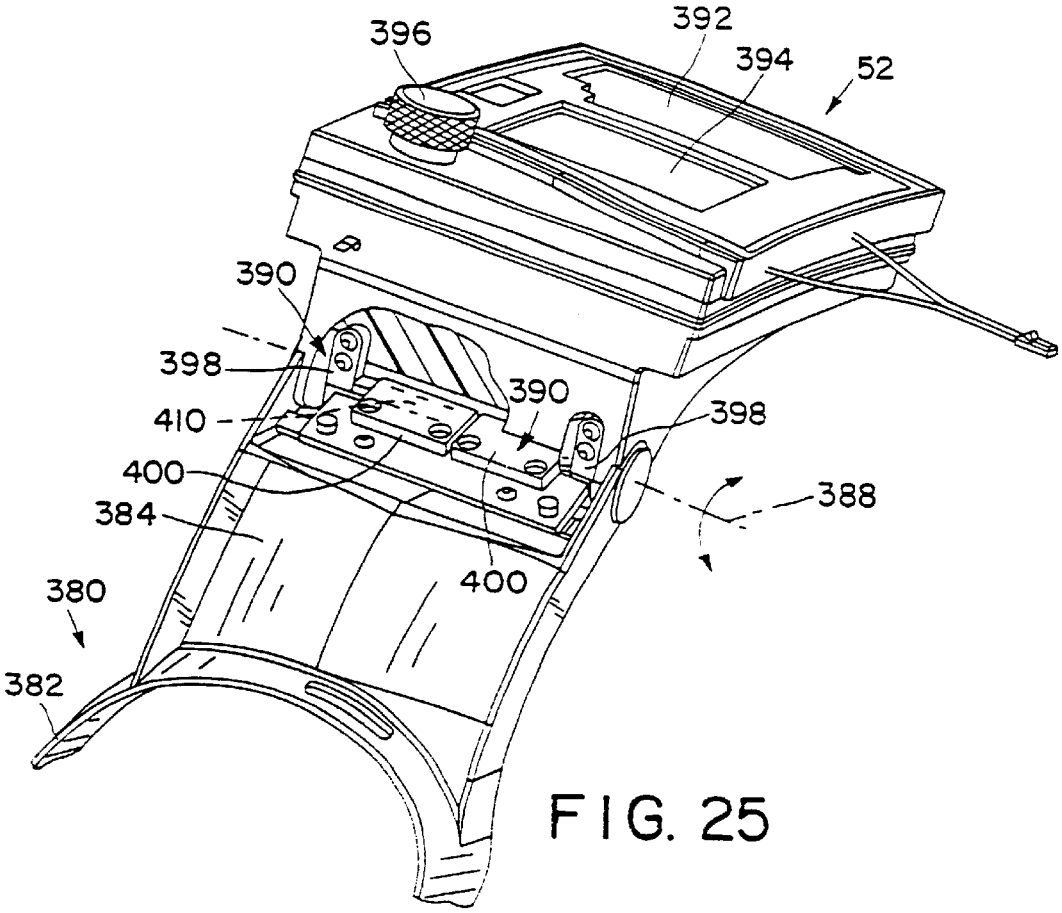
FIG. 25 is a perspective view of the user interface panel and pivot collar of FIG. 24 showing the user interface panel coupled to the pivot collar by a pair of resistive hinges configured to resist pivoting of the user interface panel in response to normal actuating forces applied to buttons of the user interface panel and to allow pivoting of the user interface panel in response to forces applied to the user interface panel that exceed the normal actuating forces.

Patient-support apparatus 20 includes user interface panel 52 as previously described. Patient-support apparatus 20 includes a pivot collar 380 having a cylindrical portion 382 and an arm 384 extending from cylindrical portion 382 as shown in FIG. 24. Cylindrical portion 382 is rotatively coupled to vertical arm 36 of canopy support arm 34 for pivoting movement about a vertical axis 386. User interface panel 52 is coupled to arm 384 of collar 380 for pivoting movement about a substantially horizontal axis 388 by a pair of resistive hinges 390, shown best in FIG. 25. Pivot collar 380 is movable about vertical axis 386 through about one hundred eighty degrees (180°) so that user interface panel 52 is movable between a first position accessible for use on a first side of patient-support apparatus 20, as shown in FIG. 1, and a second position accessible for use on a second side of patient-support apparatus 20.

User interface panel 52 includes a read-out screen 392 and a user input screen 394. A caregiver can input various environmental parameters by pressing on-screen "buttons" (not shown) that are displayed on user input screen 394. User interface panel 52 includes a knob 396 that, when rotated, cycles through a plurality of input screens, each of which allow the caregiver to enter user inputs for a corresponding system of patient-support apparatus 20. For example, one screen allows the caregiver to enter threshold noise and light levels, above which an alert light is flashed, and another screen allows the caregiver to enter desired temperature and humidity settings.

Resistive hinges 390 are configured to resist pivoting of user interface panel 52 in response to normal actuating forces applied to the buttons of user input screen 394 and to allow pivoting of user interface panel 52 in response to forces applied to user interface panel 52 that exceed the normal actuating forces. The caregiver may wish to adjust the position of user interface panel 52 to reduce glare from room lights, for example. In a preferred embodiment, resistive hinges 390 allow user interface panel 52 to pivot when a torque exceeding 30 inch-pounds (3.4 N-m) is applied to user interface panel 52. Preferred resistive hinges 390 are available from CEMA Technologies, Inc. located in Bridgeport, Pa.

Each resistive hinge 390 includes a first member 398 fastened to user interface panel 52 and a second member 400 fastened to arm 384 of collar 380. Each resistive hinge 390 also includes a hinge post 410 fixed to first member 398 and extending therefrom into second hinge member 400 along axis 388. Resistive hinges 390 further include a loop of resistive material (not shown) that is clamped against hinge post 410 inside second member 400 with a controlled amount of force so that a predetermined amount of torque is required to rotate hinge post 410 relative to second member 400.

Thus, patient-support apparatus 20 is provided with a number of hinged panels. Patient-support apparatus 20 includes side guard panels 44 and end guard panel 46 at the foot end of patient support 26 coupled to patient support 26 by respective combined hinge and latch assemblies 60. Patient-support apparatus 20 also includes access door assemblies 48 having door panels 49 coupled for pivoting movement to companion mounting blocks 210 attached to respective side guard panels 44 and levers 200 coupled to respective mounting blocks 210 for movement to lock and unlock companion door panels 49. Patient-support apparatus 20 includes grommets 50, each having a plurality of flaps 332 that are flexibly coupled to rim 330 of the respective grommet 50. Vent panels 166 are coupled to platform cover 31 of patient support 26 for pivoting movement relative to respective vent rails 164 that are each formed to include vent channels 172. In addition, patient-support apparatus 20 includes user interface panel 52 coupled to pivot collar 380 by resistive hinges 390.

Although the invention has been described in detail with reference to a certain preferred embodiment, variations and modifications exist within the scope and spirit of the invention as described and as defined in the following claims.

What is claimed is:

1. A patient-support apparatus comprising a base, a patient support carried above the base, an isolation chamber on the patient support, a system for monitoring at least one environmental condition in the isolation chamber, a user interface panel having at least one button for entering system inputs and displays for observing system outputs, the user interface panel being rotatively mounted to the patient support through a rotatable member for pivoting movement about a generally vertical axis, and a hinge connecting the user interface panel to the rotatable member to permit angling of the user interface panel with respect to the patient support.

2. The patient-support apparatus of claim 1, wherein the hinge is a resistive hinge configured to resist pivoting of the user interface panel in response to normal actuating forces applied to the at least one button of the user interface panel and configured to allow pivoting of the user interface panel in response to forces applied to the user interface panel that exceed the normal actuating forces.

3. The patient-support apparatus of claim 2, wherein the rotatable member includes a pivot collar.

4. The patient-support apparatus of claim 3, wherein the pivot collar includes a cylindrical portion and an arm extending from the cylindrical portion, the arm having at a remote end the hinge and the user interface panel being coupled to the hinge.

5. The patient-support apparatus of claim 2, wherein the resistive hinge includes a first member coupled to the user interface panel and a second member coupled to the arm, a hinge post being coupled to the first member and extending therefrom into the second member.

6. The patient-support apparatus of claim 2, wherein the forces exceeding normal actuating forces include a force applied to the user interface panel to produce a torque about an axis of the hinge that exceeds about 30 inch-pounds (3.4 N-m).

7. A patient-support apparatus comprising a base, a patient support carried above the base, an isolation chamber on the patient support, a system for monitoring at least one environmental condition in the isolation chamber, a user interface panel having at least one button for entering system inputs and displays for observing system outputs, the user interface panel being rotatively mounted to the patient support through a rotatable member for pivoting movement about a generally vertical axis, and a hinge connecting the user interface panel to the rotatable member to permit angling of the user interface panel with respect to the patient support, the angling constituting pivoting about a generally horizontal axis.

8. The patient-support apparatus of claim 7, wherein the hinge is a resistive hinge configured to resist pivoting of the user interface panel in response to normal actuating forces applied to the at least one button of the user interface panel and configured to allow pivoting of the user interface panel in response to forces applied to the user interface panel that exceed the normal actuating forces.

9. The patient-support apparatus of claim 7, wherein the rotatable member includes a pivot collar.

10. The patient-support apparatus of claim 5, wherein the pivot collar includes a cylindrical portion and an arm extending from the cylindrical portion, the arm having at a remote end at least one resistive hinge, the user interface panel being coupled to the hinge to permit at least movement of the user interface panel in response to forces exceeding normal actuating forces.

11. The patient-support apparatus of claim 10, wherein the resistive hinge includes a first member coupled to the user interface panel and a second member coupled to the arm, a hinge post being coupled to the first member and extending therefrom into the second member.

12. The patient-support apparatus of claim 10, wherein the forces exceeding normal actuating forces include a force applied to the user interface panel that produces a torque about an axis of the hinge that exceeds about 30 inch-pounds (3.4 N-m).

13. The patient-support apparatus of claim 8, wherein the rotatable member includes a pivot collar.

14. The patient-support apparatus of claim 13, wherein the pivot collar includes a cylindrical portion and an arm extending from the cylindrical portion, the arm having at a remote end the hinge and the user interface panel being coupled to the hinge.

15. The patient-support apparatus of claim 8, wherein the resistive hinge includes a first member coupled to the user interface panel and a second member coupled to the arm, a hinge post being coupled to the first member and extending therefrom into the second member.

16. The patient-support apparatus of claim 8, wherein the forces exceeding normal actuating forces include a force applied to the user interface panel to produce a torque about an axis of the hinge that exceeds about 30 inch-pounds (3.4 N-m).

17. A patient-support apparatus comprising a base, a patient support carried above the base, an isolation chamber on the patient support, a controller configured to control at least one function in the isolation chamber, and a user interface panel including a display and at least one button configured to provide an input signal to the controller, the user interface panel being coupled to the patient support by a resistive hinge configured to resist pivoting of the user interface panel in response to normal actuating forces applied to the at least one button of the user interface panel and configured to allow pivoting of the user interface panel in response to forces applied to the user interface panel that exceed the normal actuating forces.

18. The patient-support apparatus of claim 17, wherein the user interface panel pivots about a first axis relative to the patient support and the resistive hinge is configured to allow the user interface panel to pivot about a second axis when the force applied to the user interface panel produces a torque that exceeds about 30 inch-pounds (3.4 N-m).

19. The patient-support apparatus of claim 17 further comprising a rotatable member including a pivot collar and the hinge is coupled to the patient support via the pivot collar.

20. The patient-support apparatus of claim 19 wherein the pivot collar includes a cylindrical portion and an arm extending from the cylindrical portion, the arm having at a remote end at least one hinge.

21. The patient-support apparatus of claim 19, wherein the pivot collar is movable about a vertical axis through about 180 degrees.

22. A patient-support apparatus comprising a base, a patient support carried above the base, an isolation chamber on the patient support, a controller configured to control at least one function in the isolation chamber, and a user interface panel including a display and at least one button configured to provide an input signal to the controller, the user interface panel being pivotally mounted to the patient support to provide pivotal movement of the interface panel about more than one axis.

23. The patient-support apparatus of claim 22 wherein the user interface panel is coupled to a collar and the collar is pivotally mounted to the patient support.

24. The patient-support apparatus of claim 23 wherein the collar includes a cylindrical portion and an arm extending from the cylindrical portion, the arm having at a remote end at least one resistive hinge, the user interface panel being coupled to the arm through the hinge.

25. The patient-support apparatus of claim 24 wherein the hinge resists movement in response to force required to actuate the at least one button but permits movement in response to force greater than the force required to actuate the at least one button.

26. The patient-support apparatus of claim 25 wherein the force greater than the force required to actuate the at least one button is the force required to produce a torque about an axis of the hinge that exceeds about 30 inch-pounds (3.4 N-m).

27. The patient-support apparatus of claim 22, wherein the user interface panel pivots on perpendicular axes.

28. A patient-support apparatus comprising a base, a patient support carried above the base, a controller configured to control at least one function on the patient support, and user interface panel including a display and at least one button configured to provide an input signal to the controller, the user interface panel pivotally mounted to a collar coupled to the patient support to provide pivotal movement of the user interface panel about more than one axis, the collar including a cylindrical portion and an arm extending from the cylindrical portion, the arm having at a remote end at least one resistive hinge, the user interface panel being coupled to the arm through the hinge, the hinge resisting movement in response to force required to actuate the at least one button but permitting movement in response to force greater than the force required to actuate the at least one button.

29. The patient-support apparatus of claim 28 wherein the force greater than the force required to actuate the at least one button is the force required to produce a torque about an axis of the hinge that exceeds about 30 inch-pounds (3.4 N-m).

30. The patient-support apparatus of claim 28, wherein the user interface panel pivots about perpendicular axes.

31. A patient-support apparatus comprising a base, a patient support carried above the base, a controller configured to control at least one function on the patient support, and a user interface panel including a display and at least one button configured to provide an input signal to the controller, the user interface panel pivotally mounted to the patient support from at least one hinge to provide pivotal movement of the user interface panel about more than one axis, the user interface panel being coupled to a collar pivotally mounted to the patient support, the collar including a cylindrical portion and an arm extending from the cylindrical portion, the hinge provided at a remote end of the arm, the hinge being a resistive hinge and including a first member coupled to the user interface panel and a second member coupled to the arm, a hinge post being coupled to the first member and extending therefrom into the second member.

32. A patient-support apparatus comprising a base, a patient support carried above the base, a controller configured to control at least one function on the patient support, and a user interface panel including a display and at least one button configured to provide an input signal to the controller, the user interface panel pivotally mounted to the patient support from at least one hinge to provide pivotal movement of the user interface panel about more than one axis, the hinge resisting movement in response to force required to actuate the at least one button but permitting movement in response to force greater than the force required to actuate the at least one button.

33. The patient-support apparatus of claim 32, wherein the force greater than the force required to actuate the at least one button is the force required to produce a torque about an axis of the hinge that exceeds about 30 inch-pounds (3.4 N-m).

34. The patient-support apparatus of claim 32, wherein the user interface panel pivots about perpendicular axes.

35. A patient-support apparatus comprising a base, a patient support carried above the base, a support arm mounted for movement on the patient support, a controller configured to control at least one function on the patient support, and a user interface panel including a display and at least one button configured to provide an input signal to the controller, the user interface panel coupled to the support arm, the support arm including a resistive hinge coupled to the user interface panel, the hinge configured to resists movement in response to force required to actuate the at least one button but permit movement in response to force greater than the force required to actuate the at least one button.

36. The patient-support apparatus of claim 35 wherein the support arm includes a collar pivotally mounted to the patient support.

37. The patient-support apparatus of claim 35 wherein the force greater than the force required to actuate the at least one button is the force required to produce a torque about an axis of the hinge that exceeds about 30 inch-pounds (3.4 N-m).

38. The patient-support apparatus of claim 35 wherein the user interface panel is support for movement about more than one axis.

39. The patient-support apparatus of claim 38 wherein the user interface panel is supported for movement about perpendicular axes.

40. A patient-support apparatus comprising a base, a patient support carried above the base, an isolation chamber on the patient support, a support arm mounted for movement on the patient support, a controller configured to control at least one function in the isolation chamber, and a user interface panel including a display and at least one button configured to provide an input signal to the controller, the user interface panel coupled to the support arm, the support arm configured to hold the user interface panel stationary in response to in response to force required to actuate the at least one button but permit movement in response to force greater than the force required to actuate the at least one button.

41. The patient-support apparatus of claim 40 wherein the support arm includes a collar pivotally mounted to the patient support.

42. The patient-support apparatus of claim 41 wherein the collar includes a cylindrical portion and the support arm extends from the cylindrical portion, the support arm having at a remote end at least one resistive hinge, the user interface panel coupled to the hinge.

43. The patient-support apparatus of claim 42 wherein the hinge resists movement in response to force required to actuate the at least one button but permits movement in response to force greater than the force required to actuate the at least one button.

44. The patient-support apparatus of claim 43 wherein the force greater than the force required to actuate the at least one button is the force required to produce a torque about an axis of the hinge that exceeds about 30 inch-pounds (3.4 N-m).

45. The patient-support apparatus of claim 40 wherein the user interface panel is supported for movement about more than one axis.

46. The patient-support apparatus of claim 45 wherein the user interface panel is pivotally supported for movement about perpendicular axes.

* * * * *